US005909732A

United States Patent [19]

Diesel et al.

[11] Patent Number: 5,909,732

[45] Date of Patent: Jun. 8, 1999

[54] INSERT TO PROVIDE CONFORMAL SUPPORT FOR THE REFLECTIVE SEAL OF AN OXYGEN MASK

[75] Inventors: Donald A. Diesel, Floresville; Curtis D. White; Daniel M. Magaw, both of San Antonio, all of Tex.

[73] Assignee: The United States of America as represented by the Secretary of the Air Force, Washington, D.C.

[21] Appl. No.: 09/072,055

[22] Filed: May 4, 1998

[51] Int. Cl.[6] ..... A62B 18/08

[52] U.S. Cl. ..... 128/206.24; 128/206.16; 128/205.25

[58] Field of Search ..... 128/205.25, 205.27, 128/205.28, 206.16, 206.17, 206.24

[56] References Cited

U.S. PATENT DOCUMENTS

| | | | |
|---|---|---|---|
| 2,201,315 | 5/1940 | Lehmberg | 128/206.16 |
| 4,579,113 | 4/1986 | McCreadie et al. | 128/206.17 |
| 4,657,010 | 4/1987 | Wright | 128/206.16 |
| 4,770,169 | 9/1988 | Schmoegner et al. | 128/206.24 |
| 4,827,924 | 5/1989 | Japuntich | 128/206.16 |
| 5,003,633 | 4/1991 | Itoh | 128/206.24 |
| 5,062,421 | 11/1991 | Burns et al. | 128/205.27 |
| 5,143,061 | 9/1992 | Kaimer | 128/206.24 |
| 5,181,506 | 1/1993 | Tardiff, Jr. et al. | 128/206.24 |
| 5,454,369 | 10/1995 | Müller et al. | 128/206.24 |
| 5,592,937 | 1/1997 | Freund | 128/206.16 |

*Primary Examiner*—Aaron J. Lewis
*Attorney, Agent, or Firm*—Tony Y. Cole; Bobby D. Scearce; Thomas L. Kundert

[57] ABSTRACT

A mask insert to provide conformal support for the reflective seal of an oxygen mask comprising a formed rim made of a resiliently deformable material which is held in place beneath the reflective seal by a supporting framework which conforms to the contours of the interior surface of the mask. The formed rim applies constant pressure on the face-engaging surface of the reflective seal, adjusting for variations in the user's facial structure, thereby eliminating leaks.

4 Claims, 2 Drawing Sheets

INSERT TO PROVIDE CONFORMAL SUPPORT FOR THE REFLECTIVE SEAL OF AN OXYGEN MASK

RIGHTS OF THE GOVERNMENT

The invention described herein may be manufactured and used by or for the Government of the United States for all governmental purposes without the payment of any royalty.

FIELD OF THE INVENTION

The present invention relates to oxygen masks having a reflective seal and, more particularly, to a removable mask insert which provides conformal support for the reflective seal, thereby limiting deformation of the seal and providing an improved airtight fit.

BACKGROUND OF THE INVENTION

Oxygen mask comfort is an important issue for many aircrew, life support technicians, and oxygen equipment designers. Extended wear of masks under certain flight conditions continues to be necessary. An oronasal mask used for delivery of gases must be suitable for continuous wear for eight hours, and seal effectively to the face, preventing excessive inboard or outboard leakage of gas. The standard aircrew oxygen mask is equipped with two main structural components which determine the quality of fit for an individual—an external hard-shell and a silicone rubber face piece which forms the seal around the individual's nose and mouth. The hard-shell supports the internal face piece and provides structural support for inhalation and exhalation valves, the supply hose, microphone, and the mask suspension system. The face piece conforms to the hard-shell and incorporates the reflective edge seal which is pressed firmly against the face when positive pressure is delivered to the mask. If the seal is not maintained and mask pressure is lost, the anti-G (acceleration) protection (PBG) and high altitude protection (PBA) provided by positive pressure breathing is also lost, placing aircrew at risk for loss of consciousness.

For positive pressure to be maintained in the lung, a mask must create a near perfect seal around the mouth and nose. Pressures as high as 60 mm Hg are generated by the U.S. Air Force's PEG system, known as the Combined Advance Technology Enhanced Design G Ensemble (COMBAT EDGE). Other PEG and PBA systems use breathing pressures as high as 70 mm Hg. In addition, maintaining the seal as mask weight increases during +Gz is another challenge, particularly during PEG. Mask function during high acceleration forces may be a problem for aircrew who are normally able to achieve a comfortable fit at +1 Gz. The mask must function during exposures of up to +9 Gz, remain in place on the face, maintain a good seal to the skin and not interfere significantly with breathing.

With the advent of PEG and PBA positive pressure, the function and comfort of a mask are inversely related. Nearly any individual can be fitted with a standard off-the-shelf mask size if the absence of a leak is the only criterion for a good fit. For some persons, however, the discomfort due to mask tensioning pressure required to achieve an airtight seal is intolerable. For many individuals, mask discomfort may range somewhere between intolerable and bearable and aircrew performance may suffer.

For these persons the silicon rubber reflective seal fails to maintain a mask seal. Downward slippage on the face causes the seal to be forced outward and away from the face. This condition is partially correctable through additional mask tensioning and hard shell trimming. Increased strap tension, however, usually results in increased discomfort or even pain. The degree of leakage and discomfort of a properly fitted mask is dependent on the individual's facial structure. A proper aircrew oxygen mask fit is often difficult to achieve since each individual's face shape is unique, while only three or four standard mask sizes exist. The existing equipment is not designed to compensate for all variations in facial structure. Sizing systems for oxygen masks are based upon 1950's aircrew anthropometry and are only designed to fit approximately 95% of the target male population. Fitting has become increasingly difficult as females and aircrew of greater ethnic diversity assume combat aircraft roles. Increasing the number of available off-the-shelf sizes is not a cost efficient method of increasing the population coverage of mask fit.

The need therefore exists for a means of customizing standard masks to improve the seal while maintaining a comfortable fit. Applicants' invention is directed towards the solution of this problem by providing a conformal mask insert which supports the mask reflective seal from the inside of the mask cavity, pressing the reflective seal against the user's face at all points. U.S. Pat. No. 5,143,061 describes a supplemental rubber seal which augments the existing mask seal by providing additional sealing surface; however, this supplemental seal does not control the shape of, nor provide additional support to, the existing mask seal. Applicant's invention supports the backside of the existing mask seal and controls the shape of the sealing surface by providing constant pressure across the backside of the seal. Applicant's insert increases the surface contact area of the seal, evenly distributing seal pressure over a broad area of the user's face. A good seal is more easily achieved with the insert, requiring less strap tension. Therefore, comfort is improved over the existing equipment which relies upon increased strap tension to achieve an adequate seal. Applicant's invention provides the solution for those individuals who are unable to achieve a non-leaking comfortable fit with standard mask sizes.

The insert may allow a means of customizing the mask, quickly and reversibly, to benefit a relatively large proportion of the user population. The strong, flexible insert is easily but securely inserted into and removed from the mask cavity without any disassembly of existing mask components. Since the insert is relatively inexpensive and not permanently fixed to the mask, it can be used on an as-needed basis, easily removed for cleaning and maintenance and replaced periodically, if necessary. Additional benefits of the insert may include decreased mask cavity dead space (by approximately 50 ml) and perhaps improved acoustics within the mask cavity. The insert may also alleviate problems with pressure on the nose bridge for certain individuals. The mask with insert is fitted, tested, and used in the same manner as a mask without an insert as prescribed in existing technical publications.

The mask insert concept may benefit any mask design which creates an airtight seal by means of a reflective seal. Modification of the shape of the insert would allow it to be placed into any reflective seal oxygen mask design, thereby improving the comfort and function of masks for commercial and general aviation aircrew, chemical protection respirators used in industry, firefighters respirators, or any face masks which employ a reflective seal to maintain an airtight fit.

These, and other objects, features and advantages of the present invention will become apparent as the detailed description of a preferred embodiment thereof proceeds.

SUMMARY OF THE INVENTION

In carrying out principles of the present invention, in accordance with a preferred embodiment thereof, an insert for the reflective seal of an oxygen mask is provided. The insert consists of a formed foam rim which conforms to the contour of the reflective seal and is held in place beneath the reflective seal by a supporting formed framework which conforms to the contours of the interior surface of the mask face piece. The insert, intended as an adjunct to existing equipment, serves to support the currently unsupported reflective silicon rubber seal. The insert conforms to every variation in facial structure, thereby eliminating leaks. The foam adjusts to pressure changes caused by both centrifugal force and mask cavity pressure, ensuring a constant seal under varying conditions. The insert is secured in the mask cavity by being braced between the valves and reflective seal and therefore does not present a potential foreign object or debris (FOD) problem.

DESCRIPTION OF THE DRAWINGS

The present invention will be more clearly understood from a reading of the following detailed description in conjunction with the accompanying drawings wherein.

DETAILED DESCRIPTION OF THE INVENTION

Figure 1:
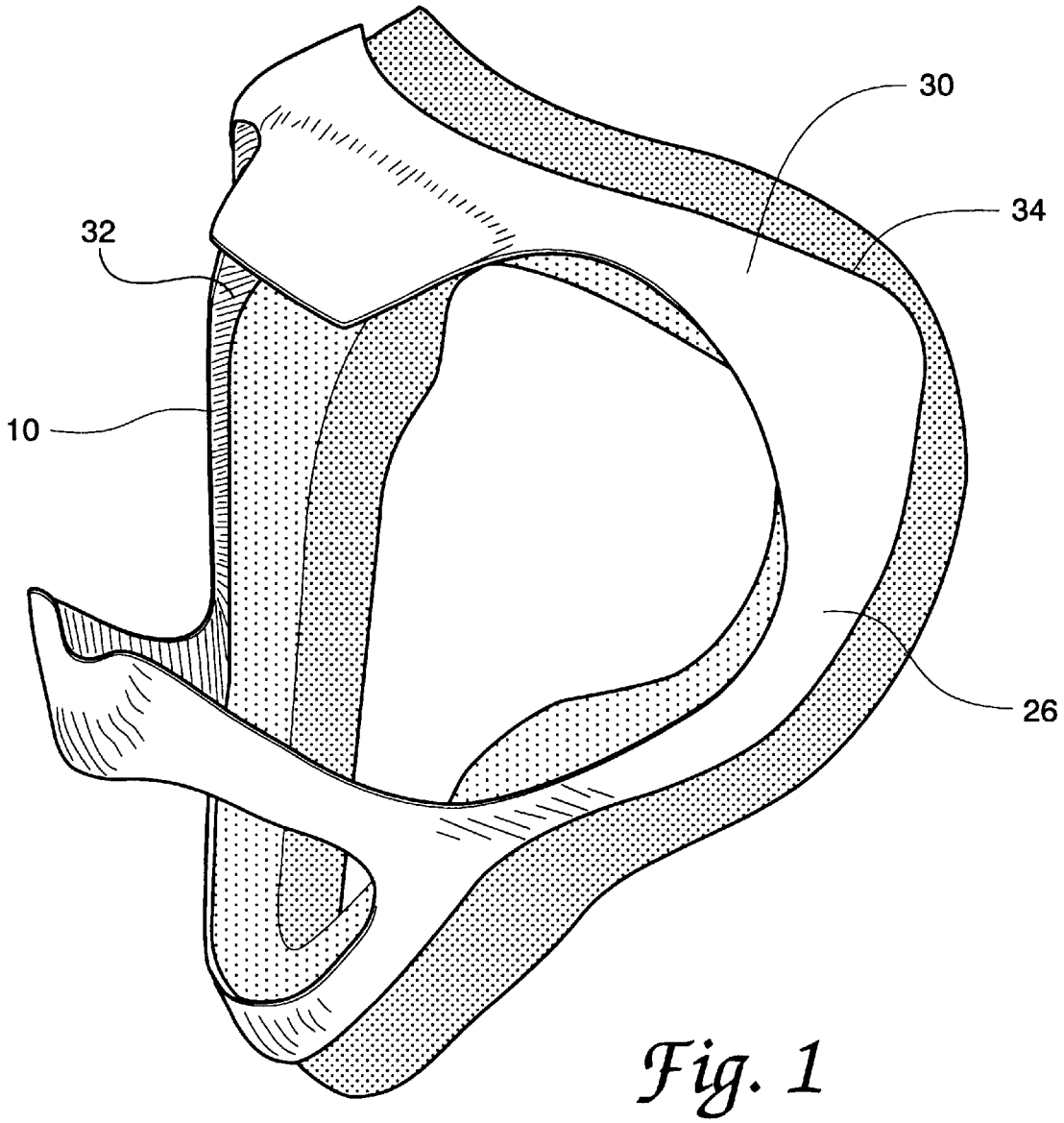
FIG. 1 shows an insert for a reflective seal oxygen mask constructed according to a preferred embodiment of the present invention.
Figure 3A:
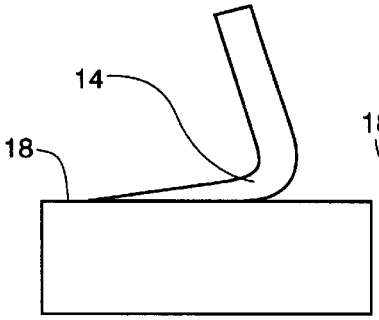
FIG. 3*a* shows the reflective seal tying against the surface of the user's face.
Figure 3B:
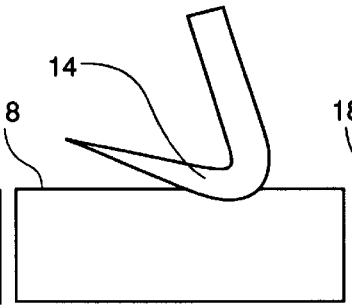
FIG. 3*b* shows the reflective seal folding away from the user's face as mask pressure increases.
Figure 3C:
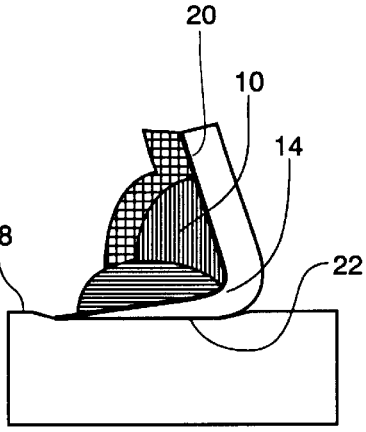
FIG. 3*c* shows a mask insert positioned beneath and supporting the reflective seal.
Figure 2:
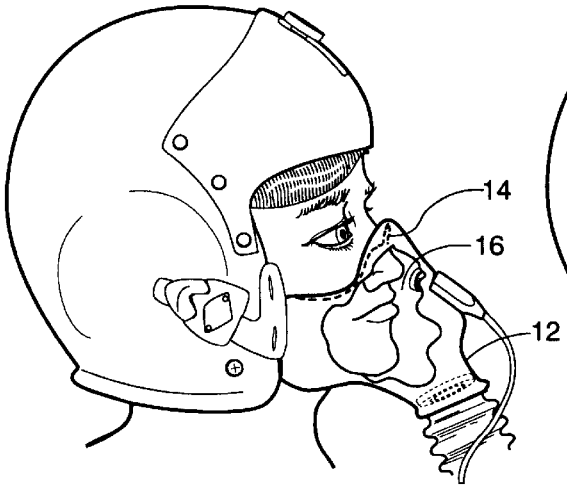
FIG. 2 shows a user wearing a reflective seal oxygen mask.

Illustrated at 10 in FIG. 1 is a preferred embodiment of an insert for a reflective seal oxygen mask. As shown in FIG. 2, a reflective seal oxygen mask 12 obtains a seal between the mask and the face of the user by reflecting the edge 14 of the mask's rubber face piece to lie against the surface of the face inside the mask cavity 16. In theory, as illustrated in FIG. 3*a,* a slight tension in the reflected edge seal 14 causes it to lie snugly against the face surface 18 and any increase in mask pressure tends to improve the seal even further. However, as shown in FIG. 3*b,* with an increase in mask pressure, reflective seal 14 frequently becomes deformed, folding back into the mask cavity and away from face surface 18 in some regions. Thus, the surface contact area with face surface 18 becomes a narrow ridge along the periphery of seal 14. As shown in FIG. 3*c,* a mask insert 10 positioned beneath reflective seal 14 provides support to reflective seal 14, limiting deformation, and distributing the force applied to face surface 18 more evenly and over a larger surface area. Insert 10 conformingly engages the inner surface 20 of reflective seal 14 and presses the outer surface 22 of reflective seal 14 against the user's face to form an air-tight seal.

Figure 4:
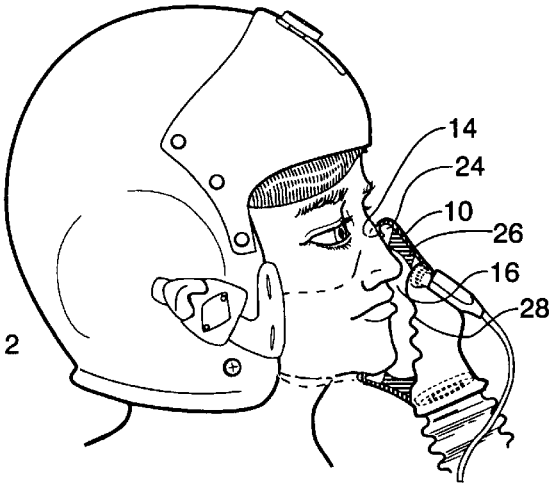
FIG. 4 shows a user wearing a reflective seal oxygen mask fitted with the insert.

As shown in FIG. 4, mask insert 10 is securely mounted in mask cavity 16. Insert 10 consists of a one-quarter inch formed foam rim 24 which is held in place beneath reflective seal 14 by a 3/32 inch supporting framework 26 which conforms to the contours of the interior surface 28 of the mask face piece. Foam rim 24 is made of a resiliently deformable material, such as E-A-R Isoloss CF47025 Confor (™) foam or similar urethane foam material. Supporting framework 26 is made of a suitably light weight, durable material which is rigid but allows for flexing, such as KYDEX (™) a copolymeric mixture of polyvinylchloride and polyacrylic plastic material.

As shown in FIG. 1, supporting framework 26 has an outer side 30 which is adapted to conformingly engage the interior surface of the mask, an opposite inner side 32 which confronts the user's face, and a marginal facial edge 34. Supporting framework 26 is shaped by vacuum forming a sheet of 3/32 inch thick KYDEX (™), a copolymeric mixture of polyvinylchloride and polyacrylic plastic material, or similar material over a plaster cast of the mask face piece interior. This thin (3/32 inch-thick) formed shell is then trimmed to reduce its weight and to allow openings for the mask's inhalation and exhalation valves and microphone. The facial edge is trimmed to a distance away from the user's face. Suitable foam material is attached to supporting framework 26 adjacent to marginal edge 34 and shaped to follow the contour of the inner surface of the reflective seal.

As shown in FIG. 4, supporting framework 26 serves as a platform to secure foam rim 24 within the mask cavity. Foam rim 24 serves to apply constant pressure on the outer face-engaging surface 22 of reflective seal 14 in order to adjust for variations in the user's facial structure, thereby eliminating leaks. Foam rim 24 adjusts to pressure changes caused by both centrifugal force and mask cavity pressure, ensuring a constant seal under varying conditions. When insert 10 is not used, reflective seal 14 is free to fold back into mask cavity 16 and away from the surface of the face.

The teachings of all patents, journal articles and other references cited herein are incorporated herein by reference. It is understood that modifications to the invention may be made as might occur to one with skill in the field of the invention within the scope of the appended claims. All embodiments contemplated thereunder which achieve the objects of the invention have therefore not been shown in complete detail. Other embodiments may be developed without departing from the spirit of the invention or from the scope of the appended claims.

We claim:

1. A removable mask insert for providing conformal support for a reflective seal of an oxygen mask to limit deformation of a reflective seal when a reflective seal is engaged with a user's face, said insert being securely mounted into the cavity of an oxygen mask, said insert comprising:

(a) a thin formed shell having an outer side adapted to be placed in conforming engagement with the interior surface of an oxygen mask, an opposite inner side adapted to confront a user's face, and a marginal facial edge adapted to be maintained in spaced relation to a user's face; and (b) a formed rim made of resiliently deformable material attached to said marginal edge, wherein said shell is rigid relative to said rim and functions as a supporting framework to said rim to hold said rim in place in conforming engagement with an inner surface of a reflective seal such that said rim presses an outer face-engaging surface of a reflective seal against a user's face to conform to the contours of a user's face to form an airtight seal therewith.

2. The insert of claim 1 wherein said shell is made of a durable, flexible material.

3. The insert of claim 1 wherein said shell is made of a copolymeric mixture of polyvinylchloride and polyacrylic plastic material.

4. The insert of claim 1 wherein said rim is made of a urethane foam material.

* * * * *